US008088255B2

(12) United States Patent
Alev et al.

(10) Patent No.: US 8,088,255 B2
(45) **Date of Patent: *Jan. 3, 2012**

(54) SHEET STABILIZER WITH DUAL INLINE MACHINE DIRECTION AIR CLAMPS AND BACKSTEPS

(75) Inventors: Tamer Mark Alev, Vancouver (CA); Salvatore Chirico, Port Moody (CA)

(73) Assignee: Honeywell ASCa Inc, Mississauga (CA)

( * ) Notice: Subject to any disclaimer, the term of this patent is extended or adjusted under 35 U.S.C. 154(b) by 729 days.

This patent is subject to a terminal disclaimer.

(21) Appl. No.: 12/105,274

(22) Filed: Apr. 18, 2008

(65) Prior Publication Data

US 2009/0260771 A1 Oct. 22, 2009

(51) Int. Cl.

| | |
|---|---|
| ***B65H 23/24*** | (2006.01) |
| ***B65H 20/10*** | (2006.01) |
| ***B65H 29/18*** | (2006.01) |
| ***D21F 1/42*** | (2006.01) |
| ***D21F 7/06*** | (2006.01) |
| ***D21F 9/00*** | (2006.01) |
| ***G01B 11/06*** | (2006.01) |

(52) U.S. Cl. ..... 162/263; 162/289; 226/97.3; 34/114; 406/88; 700/127

(58) Field of Classification Search ..... 162/193, 162/198, 199, 202, 263, 272, 275, 289; 226/7, 226/97.3; 34/114–122; 406/88, 197; 700/127–129
See application file for complete search history.

(56) References Cited

U.S. PATENT DOCUMENTS 3,385,490 A * 5/1968 Malmgren et al. ..... 226/7
3,549,070 A * 12/1970 Downham et al. ..... 242/615.11
3,587,177 A 6/1971 Overty
3,763,571 A * 10/1973 Vits ..... 34/641
4,074,841 A * 2/1978 Kramer et al. ..... 226/97.3
4,137,644 A * 2/1979 Karlsson ..... 34/460
4,252,512 A 2/1981 Kornylal
4,271,601 A * 6/1981 Koponen et al. ..... 34/641
(Continued)

FOREIGN PATENT DOCUMENTS

EP 0415460 B1 3/1991
(Continued)

OTHER PUBLICATIONS

Quadracci et al, Heat Transfer of an Inclined Coanda Jet to a Flexible Web, ASME Paper 94-WA/HT-21 (1994) New York, NY USA.

*Primary Examiner* — Jose A Fortuna
(74) *Attorney, Agent, or Firm* — Cascio Schmoyer & Zervas

(57) ABSTRACT

An air stabilization system employing two substantially parallel, codirectional Coanda nozzles, that are positioned adjacent a flexible moving web, with each nozzle exhausting gas at the same downstream machine direction, subjects the moving web to shear forces effective to stabilize the web. Each nozzle includes an elongated slot that is substantially perpendicular to the path of the moving web and a backstep located downstream of the direction of airflow extending from the Coanda slot. The two Coanda nozzles serve as separate points along the machine direction for controlling the height of the moving web. By modulating the velocities or other parameters of gases exiting the Coanda nozzles, the shape of the moving web between the nozzles can be manipulated to present a planar contour for measurements. The air stabilization system can be incorporated into a scanner head to measure the caliper of paper, plastic, and other flexible web products.

16 Claims, 4 Drawing Sheets

U.S. PATENT DOCUMENTS

| | | | | | |
|---|---|---|---|---|---|
| 4,336,017 | A | | 6/1982 | Desty | |
| 4,601,116 | A | | 7/1986 | Krimsky | |
| 4,678,915 | A | | 7/1987 | Dahlquist | |
| 4,879,471 | A | | 11/1989 | Dahlquist | |
| 4,932,140 | A | * | 6/1990 | Lepisto | 34/641 |
| 5,067,509 | A | | 11/1991 | Hunter | |
| 5,094,535 | A | | 3/1992 | Dahlquist | |
| 5,156,312 | A | * | 10/1992 | Kurie | 242/615.11 |
| 5,166,748 | A | | 11/1992 | Dahlquist | |
| 5,299,364 | A | * | 4/1994 | Heikkila et al. | 34/460 |
| 5,355,083 | A | | 10/1994 | George | |
| 5,829,166 | A | * | 11/1998 | Klas | 34/641 |
| 6,003,750 | A | * | 12/1999 | Hermsen | 226/91 |
| 6,193,810 | B1 | | 2/2001 | Baum | |
| 6,281,679 | B1 | | 8/2001 | King | |
| 6,743,338 | B2 | | 6/2004 | Graeffe | |
| 6,936,137 | B2 | | 8/2005 | Moeller | |
| 6,967,726 | B2 | | 11/2005 | King | |
| RE39,601 | E | * | 5/2007 | Svanqvist | 162/193 |
| 7,530,179 | B2 | * | 5/2009 | Rocheleau | 34/640 |
| 7,892,399 | B2 | * | 2/2011 | Graham et al. | 162/193 |
| 2006/0032598 | A1 | | 2/2006 | Milosavljevic | |
| 2009/0260771 | A1 | * | 10/2009 | Alev et al. | 162/207 |
| 2009/0260772 | A1 | * | 10/2009 | Alev et al. | 162/207 |
| 2009/0294084 | A1 | * | 12/2009 | Duck et al. | 162/202 |
| 2010/0078140 | A1 | * | 4/2010 | Hughes | 162/202 |

FOREIGN PATENT DOCUMENTS

| | | | | |
|---|---|---|---|---|
| EP | 0561256 | B1 | | 9/1993 |
| EP | 0566552 | B1 | | 10/1993 |
| WO | WO 99/02773 | A1 | | 1/1999 |
| WO | WO 2009127054 | A1 | * | 10/2009 |
| WO | WO 2009129056 | A1 | * | 10/2009 |
| WO | WO 2009148852 | A2 | * | 12/2009 |

* cited by examiner

SHEET STABILIZER WITH DUAL INLINE MACHINE DIRECTION AIR CLAMPS AND BACKSTEPS

FIELD OF THE INVENTION

The present invention relates generally to an air stabilizer device for non-contacting support of a moving flexible continuous web of material. The air stabilizer employs two codirectional nozzles that apply shear forces to the moving web. By regulating the flow of the two jets of gas that are exhausted from the nozzles, the profile of the web as it passes over the air stabilizer can be controlled.

BACKGROUND OF THE INVENTION

In the manufacture of paper on continuous papermaking machines, a web of paper is formed from an aqueous suspension of fibers (stock) on a traveling mesh papermaking fabric and water drains by gravity and suction through the fabric. The web is then transferred to the pressing section where more water is removed by pressure and vacuum. The web next enters the dryer section where steam heated dryers and hot air completes the drying process. The paper machine is, in essence, a water removal system. A typical forming section of a papermaking machine includes an endless traveling papermaking fabric or wire, which travels over a series of water removal elements such as table rolls, foils, vacuum foils, and suction boxes. The stock is carried on the top surface of the papermaking fabric and is de-watered as the stock travels over the successive de-watering elements to form a sheet of paper. Finally, the wet sheet is transferred to the press section of the papermaking machine where enough water is removed to form a sheet of paper.

It is well known to continuously measure certain properties of the paper material in order to monitor the quality of the finished product. These on-line measurements often include basis weight, moisture content, and sheet caliper, i.e., thickness. The measurements can be used for controlling process variables with the goal of maintaining output quality and minimizing the quantity of product that must be rejected due to disturbances in the manufacturing process. The on-line sheet property measurements are often accomplished by scanning sensors that preiodically traverse the sheet material from edge to edge. It is conventional to measure the caliper of sheet material upon its leaving the main dryer section or at the take-up reel with scanning sensors, as described, for example, in U.S. Pat. No. 6,967,726 to King et al. and U.S. Pat. No. 4,678,915 to Dahlquist et al.

In order to precisely measure some of the paper's characteristics, it is essential that the fast moving sheet of paper be stabilized at the point of measurement to present a consistent profile since the accuracy of many measurement techniques requires that the web stay within certain limits of flatness, height variation and flutter. U.S. Pat. No. 6,743,338 to Graeffe et al. describes a web measurement device having a measurement head with a reference surface that includes a plurality of holes formed therein. The reference part is configured so that there is an open space or channel below the reference part. By generating a negative pressure in the open space, suction force is exerted on the web to causes it be supported against the reference surface substantially over the entire measuring area. With such contacting methods, debris and contaminants tend to build on the sensing elements which adversely affect the accuracy of the measuring device. Moreover, to avoid paper degradation, stabilization must be accomplished without contact to the stabilizing device. This is critical at the high speed at which web material such as paper is manufactured.

U.S. Pat. No. 6,281,679 to King et al. describes a non-contact web thickness measurement system which has dual sensor heads each located on opposite sides of a moving web. The system includes a web stabilizer that is based on a vortex of moving air and includes a clamp plate that is mounted near the web, which is to be stabilized, and a circular air channel within the clamp plate that is coincident with its upper surface. When air is introduced into the circular air channel, a field of low pressure is created over the channel and the web is pulled toward this ring of low pressure. While these vortex-type air clamps do provide adequate air bearing support they also create a "sombrero-type" profile on the web material in the center of its effective region, thus they do not generate a sufficiently flat profile for measurements. In measuring paper thickness, it has been found that this stabilizer system does not produce a sufficiently planar sheet profile.

U.S. Pat. No. 6,936,137 to Moeller et al. describes a linear air clamp or stabilizer, for supporting a moving web, which employs a single Coanda nozzle in conjunction with a "backstep" which is a depression downstream from the nozzle. As the web moves downstream over the air stabilizer, a jet of gas is discharged from the single nozzle in a downstream direction that is parallel to the movement of the web. With this stabilizer, a defined area of web material rides on an air bearing as the web passes over the air clamp surface where a thickness measurement device is positioned.

When employed in a papermaking machine, a non-contacting caliper sensor is particularly suited for measuring the thickness of the finished paper near the take-up reel. The heads of the sensor are positioned on a scanner system that generally includes a pair of horizontally extending guide tracks that span the width of the paper. The guide tracks are spaced apart vertically by a distance sufficient to allow clearance for paper to travel between the tracks. The upper head and lower head are each secured to a carriage that moves back-and-forth over paper as measurements are made. The upper head includes a device that measures the height between the upper head and the upper surface of the web and the lower head includes a device that measures the height between the lower head to the lower surface of the web.

The lower head includes an air stabilizer to support the moving paper. Ideally, the interrogations spots of each laser triangulation device are directly above each other. The lower head and upper head are interchangeable depending on the application. Accurate and precise measurements are attained when the two heads are in alignment but scanner heads will deviate from perfect alignment over time. A caliper sensor with misaligned sensor heads will not accurately measure a sheet that is not flat and current air stabilizers do not adequately support the moving sheet to present a sufficiently flat profile for measurement.

SUMMARY OF THE INVENTION

The present invention is based in part on the development of an air stabilization system that subjects a moving flexible web, which is traveling in the machine direction, to shear forces sufficient to stabilize the web. This is achieved by employing two preferably parallel, codirectional, elongated Coanda nozzles below the moving web with each nozzle exhausting gas in the same downstream machine direction as the moving web. Each nozzle includes an elongated slot that is preferably perpendicular to the path of the moving web. The locations of the two Coanda nozzles serve as separate positions on the machine direction for controlling the height of the moving web. By regulating the flow rates and/or other parameters of the jets exiting the nozzles, the contour of the web can be manipulated to exhibit a planar contour between two the Coanda nozzles to enable accurate thickness and other measurements. The air stabilization system's clamping capacity can be enhanced by increasing the flow rates of the two exhausting gases.

In one aspect, the invention is directed to an air stabilization system for non-contact support of a flexible continuous web that is moving in a downstream machine direction (MD) that includes:

(a) a body having an operative surface facing the web wherein the operative surface has a web entry end and a web exit end that is downstream from the web entry end;

(b) a first nozzle, positioned at the web entry end, that defines a first slot that extends across the surface of the operative surface along a first direction that is substantially transverse to the MD and wherein a first elongated jet of pressurized gas is exhausted through the first slot and moves toward a downstream MD to impart a first controlled force on the web; and (c) a second nozzle, positioned at the web exit end, that defines a second slot that extends across the surface of the operative surface along a second direction that is substantially transverse to the MD, wherein a second elongated jet of pressurized gas is simultaneously exhausted through the second slot and moves toward a downstream MD to impart a second controlled force on the web and whereby the first force and the second force maintain at least a portion of the moving web, that is located between the web entry end and the web exit end, at a substantially fixed distance to the operative surface.

In another aspect, the invention is directed to a method of non-contact support of a flexible continuous web that is moving in a downstream machine direction (MD) along a path that comprises the steps of:

(a) positioning an air stabilizer below the continuous web along the path wherein the stabilizer includes:

(i) a body having an operative surface facing the web wherein the operative surface has a web entry end and a web exit end that is downstream from the web entry end;

(ii) a first nozzle, positioned at the web entry end, that defines a first slot that extends across the surface of the operative surface along a first direction that is substantially transverse to the MD, wherein the first nozzle is fluid communication with a first source of gas; and (iii) a second nozzle, positioned at the web exit end, that defines a second slot that extends across the surface of the operative surface along a second direction that is substantially transverse to the MD wherein the second nozzle is fluid communication with a second source of gas;

(b) directing a first jet of gas from the first slot toward a downstream MD to impart a first force on the continuous web; and (c) simultaneously directing a second jet of gas from the second slot toward a downstream MD to impart a second force on the continuous web, whereby the first force and the second force maintain at least a portion of the moving web, that is located between the web entry end and the web exit end, at a substantially fixed distance to the operative surface.

In a further aspect, the invention is directed to a system for monitoring a continuous web that is moving in a downstream machine direction (MD) that includes:

(a) an air stabilization system for non-contact support of the flexible continuous web, which has a first surface and a second surface, that includes:

(i) a body having an operative surface facing the web wherein the operative surface has a web entry end and a web exit end that is downstream from the web entry end;

(ii) a first nozzle, positioned on the operative face at the web entry end, that defines a first slot that extends across the surface of the operative surface along a first direction that is substantially transverse to the MD and wherein a first elongated jet of pressurized gas is exhausted through the first slot and moves toward a downstream MD to impart a first controlled force on the web; and (iii) a second nozzle, positioned on the operative face at the web exit end, that defines a second slot that extends across the surface of the operative surface along a second direction that is substantially transverse to the MD, wherein a second elongated jet of pressurized gas is simultaneously exhausted through the second slot and moves toward a downstream machine direction to impart a second controlled force on the web and whereby the first force and the second force maintain at least a portion of the moving web, that is located between the web entry end and the web exit end, at a substantially fixed distance to the operative surface;

(b) a first sensor head that is disposed adjacent the first surface of the web; and (c) means for regulating the first jet of gas and the second jet of gas to control the web's profile along the process path over the operative surface.

DESCRIPTION PREFERRED EMBODIMENTS

Figure 1A:
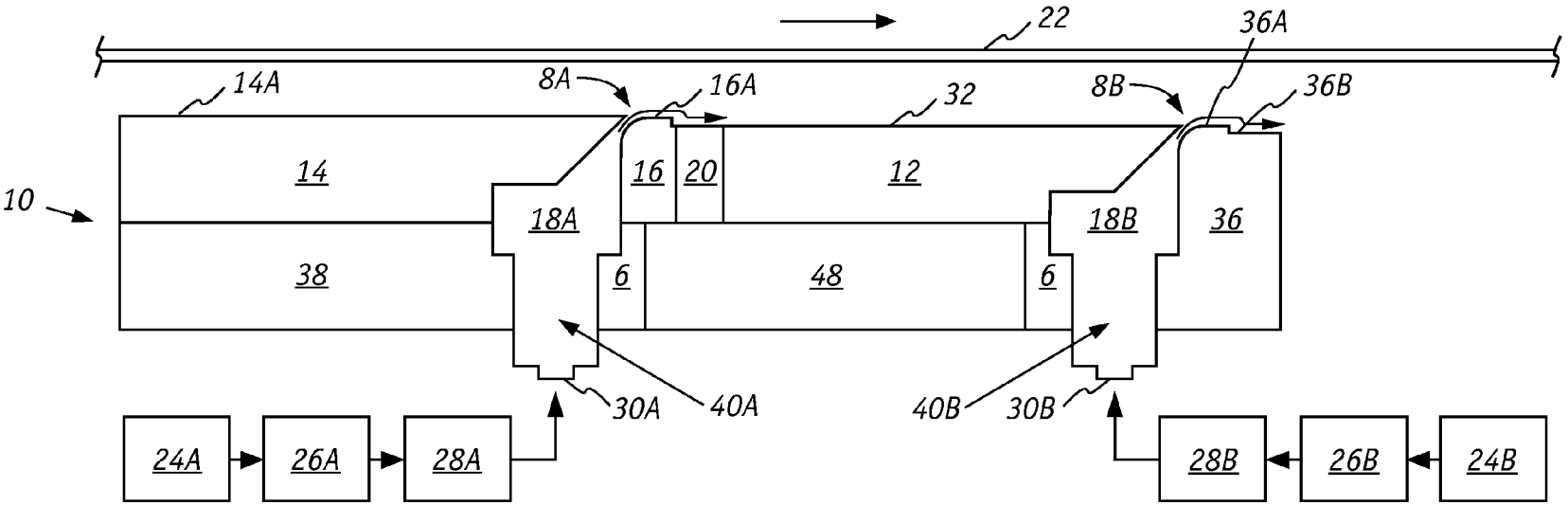
FIG. 1A is a cross sectional view of an embodiment of the air stabilizer system.

FIG. 1A illustrates an embodiment of an air stabilization system 10 that includes a stainless steel body that features dual Coanda nozzles each of which exhausts a stream of gas in the downstream machine direction. The body is segmented into a central region 12 and 16, lateral region 14 and lateral region 36. Lateral region 36 has an elevated portion with surface 36A and a lower portion with surface 36B. The central region comprises an elevated portion 16 with surface 16A and a lower portion 12 that has an operative surface 32 that is situated between Coanda nozzles 8A and 8B. The sensor device 20 has an upper surface that is flush with operative surface 32 and is part of the operative surface 32. Surface 14A of lateral region 14 is coplanar with surface 16A while operative surface 32 is coplanar with surface 36A.

The body further includes a lower middle portion 6 which supports central region 12 and 16 and a lower lateral portion 38 which supports lateral portion 14. Aperture 48 permits access to sensor device 20. The air stabilization system 10 is positioned underneath a web of material 22 which is moving from left to right relative to the system; this direction being referred to as the downstream machine direction (MD) and the opposite direction being the upstream machine direction. The cross direction (CD) is transverse to the MD.

As further described herein, the contour of web 22 as it travels over operative surface 32 can be controlled with the air stabilization system. In a preferred application of the air stabilization system, the profile of web 22 is substantially planar. Furthermore, the vertical height between web 22 and operative surface 32 can be regulated by preferably controlling the flow of the gases exhausting through Coanda nozzles 8A and 8B. The higher the speed of the gases, the greater the suction force generated by the nozzles that is applied to the web 22. The Coanda nozzles function as air clamps for web 22.

The body of air stabilization system 10 further defines a chamber 18A that serves as an opening for Coanda nozzle 8A and a chamber 18B that serves as an opening for Coanda nozzle 8B. Chamber 18A is connected to plenum chamber 40A which in turn is connected to a source of gas 24A via conduit 30A. The gas flow rate into plenum 40A can be regulated by conventional means including pressure controller 28A and flow regulator valve 26A. The length of chamber 40A, as measured along the cross direction, preferably matches that of Coanda nozzle 8A. Plenum 40A essentially serves as a reservoir in which high pressure gas equilibrates before being evenly distributed along the length of Coanda nozzle 8A via chamber 18A. Conduit 30A can include a single channel which connects the source of gas 24A to plenum 40A; alternatively a plurality of holes drilled into the lower surface of the body can be employed. The plurality of holes should be spaced apart along the cross direction of the body in order to distribute gas evenly into plenum 40A.

Similarly, chamber 18B is in gaseous communication with plenum chamber 40B which is connected to a source of gas 24B via conduit 30B. Gas flowing into plenum 40B is regulated by pressure controller 28B and flow regulator valve 26B. The configurations of chamber 40B and conduit 30B are preferably the same as those of chamber 40A and conduit 30A, respectively.

Any suitable gas can be employed in gas sources 24A and 24B including for example, air, helium, argon, carbon dioxide. For most applications, the amount of gas employed is that which is sufficient maintain of gas flow rate through plenums 40A and 40B at about 2.5 to 7.0 cubic meters per hour (100 to 250 standard cubic feet per hour (SCFH)) and preferably at about 3.6 to 4.2 cubic meters per hour (130 to 150 SCFH). The gas discharges through the Coanda nozzles at a velocity of about 20 m/s to about 400 m/s, or higher. By regulating the velocities of the gaseous jets exiting Coanda nozzles 8A, 8B, the distance that moving web 22 is maintained above operative surface 32 can be adjusted. The air stabilization system can be employed to support a variety of flexible web products including paper, plastic, and the like. For paper that is continuously manufactured in large scale commercial papermaking machines, the web can travels at speeds of 200 m/min to 1800 m/min or higher. In operation, the air stabilization system preferably maintains the paper web 22 at a distance ranging from about 100 μm to about 500 μm above operative surface 32.

Figure 1C:
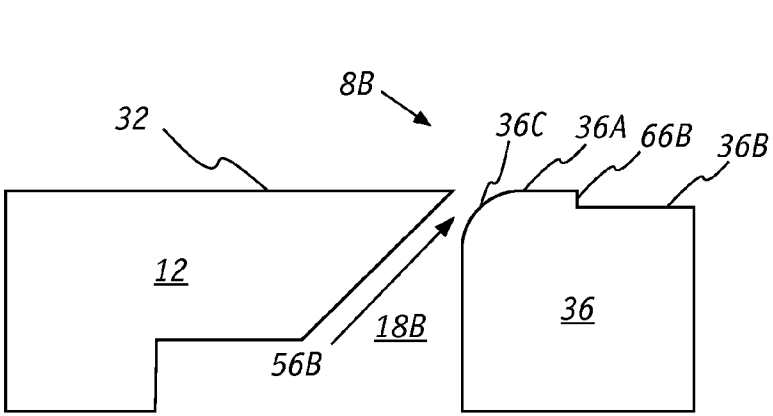
FIGS. 1B and 1C are enlarged, partial cross sectional views of Coanda nozzles.
Figure 1B:
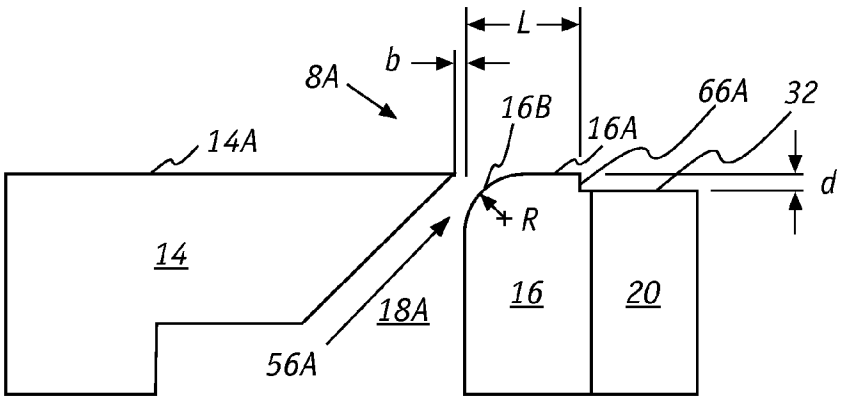

As illustrated in FIG. 1B, Coanda nozzle 8A has an opening or Coanda slot 56A between upper surfaces 14A and 16A. Coanda slot 56A has a curved surface 16B on its downstream side. Preferably this surface has a radius of curvature (R) ranging from about 1.0 mm to about 10 mm, and in one embodiment it is about 1.6 mm. Airflow from the Coanda slot 56A follows the trajectory of the curved surface 16B. The term "backstep" is meant to encompass a depression on the stabilizer surface located a distance downstream from Coanda slot 56A preferably sufficient to create a vortex. The combination of the Coanda slot and backstep generates an amplified suction force and an extensive air bearing.

Specifically, backstep 66A allows a Coanda jet to expand and create an additional suction force. It should be noted that jet expansion is necessary to create the suction force but vortex formation is not a prerequisite. Indeed, vortex formation does not always occur downstream from the backstep and is not necessary for operation of the air clamp stabilizer. The stabilizer's suction force initially draws the web closer to the stabilizer as the web approaches the stabilizer. Subsequently, the air bearing supports and reshapes the web so that the web exhibits a relatively flat profile as it passes over the backstep. While backstep 66A is most preferably configured as a 90 degrees vertical wall, the backstep can exhibit a more gradual contour so that the upper and lower surfaces can be joined by a smooth, concavely curved surface. Preferably, slot 56A has a width (b) of about 3 mils (76 μm) to 4 about mils (102 μm). The distance (d) from the upper to lower surfaces is preferably between about 100 to 1000 μm. Preferably the backstep location (L) is about 1 mm to about 6 mm and preferably about 2 mm to 3 from Coanda slot 56A.

Similarly, as shown in FIG. 1C, Coanda nozzle 8B has an opening or Coanda slot 56B between upper surfaces 32 and 36A. Coanda slot 56B has a curved surface 36C on its downstream side and backstep 66B. The dimensions of structures forming Coanda nozzle 8B can be the as those for Coanda nozzle 8A.

A flat paper profile in the machine direction of the stabilizer can be established with the dual air clamps operating in tandem. With the dual air clamp stabilizers, the paper profile flatness is also maintained in the cross flow direction since the configuration of the surface of the stabilizer is symmetric in this dimension. One advantage is that the paper profile flatness can be scaled arbitrarily in the cross flow direction. Indeed, the dimensions of the air clamp stabilizer can be readily scaled to accommodate the size, weight, speed, and other variable associated with the moving web. Specifically, in particularly for each Coanda nozzle, its (i) slot width (b) (ii) curvature radius (R), (iii) depth of backstep (d), and (iv) distance of the backstep from slot (L), can be optimized systematically for a particular application and can be adapted depending on the properties, e.g., speed and weight, of the web material.

As shown in FIGS. 1A, the sheet stabilizer incorporates a sensor device 20 situated between elevated portion 16 and lower portion 12. Simultaneous operation of the dual Coanda nozzles 8A and 8B engages sheet 22 so that its profile is substantially flat as the sheet passes over operative surface 32 between backstep 66A and Coanda slot 56B (FIGS. 1B and 1C). In a preferred embodiment as shown in FIG. 1B, sensor device 20 is positioned immediately downstream of backstep 66A. It has been demonstrated that by employing the second Coanda nozzle 8B, located at the web exit end, which is downstream from the first Coanda nozzle 8A, located at the web entry end, the sheet's flat contour can be maintained despite the presence of disruptive forces on the sheet which otherwise would cause the sheet to oscillate when only a single Coanda nozzle is employed.

The higher the air velocities from the dual nozzles, the greater the clamping forces generated. With the air stabilization system, by increasing or decreasing the clamping force from the dual nozzles, the distance between moving web 22 and operative surface 32 can be correspondingly decreased or increased.

Figure 2:
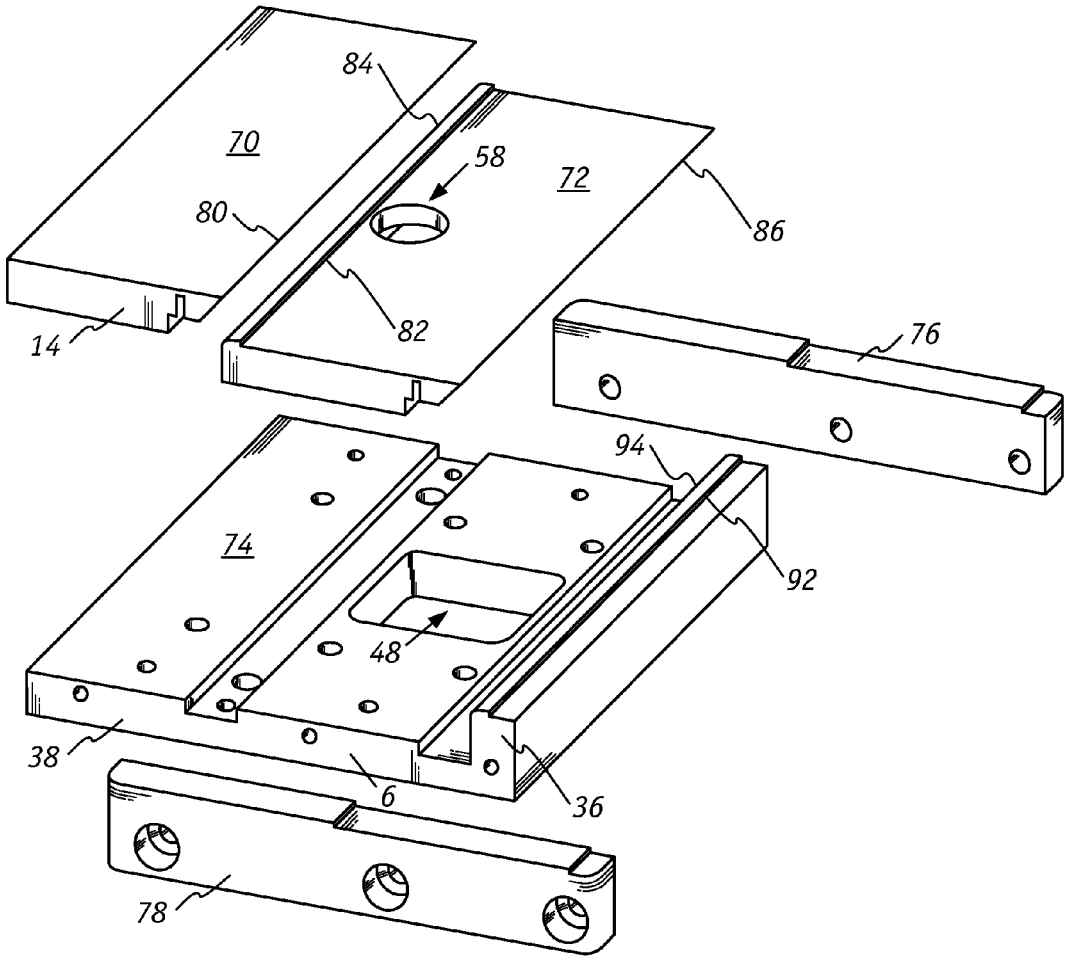
FIG. 2 is a perspective view of the air stabilizer system in dissembled form.

As shown in FIG. 2, the air stabilizing system can be constructed from five basic units that include a first upper body member 70, second upper body member 72, a lower body member 74, and side supports 76, 78. They are attached together by conventional means including dowels and screws. The generally rectangular-shaped second body member 72 has an inner perimeter that defines a curved surface 84, an outer perimeter 86, backstep 82, and measurement orifice 58 to accommodate a measurement device. The first upper body member 70 has an inner perimeter 80 that is aligned with a curved surface 84 of second upper body member 72. Lower body member 74 includes a middle portion 6 and lateral portions 38 and 36. The elevated surface of lateral portion 36 defines a curved surface 94 and backstep 92. The air stabilizing system is formed by securing first and second upper body members 70, 72 onto lower body member 74 so that the contour of the upper surfaces exhibit the profile shown in FIG. 1A. That is, the air stabilizing system has two co-directional Coanda nozzles each with a backstep, with the nozzles configured to exhaust gas in the downstream machine direction. Side supports 76 and 78 seal the internal plenums and chambers.

The air stabilization system can be incorporated into in-line dual head scanning sensor systems for papermaking machines which are disclosed in U.S. Pat. Nos. 4,879,471 to Dahlquist, U.S. Pat. No. 5,094,535 to Dahlquist et al., and U.S. Pat. No. 5,166,748 to Dahlquist, all of which are incorporated herein by reference. The width of the paper in the papermaking machines generally ranges from 5 to 12 meters and typically is about 9 meters. The dual heads, which are designed for synchronized movement, consist of an upper head positioned above the sheet and a lower head positioned below the sheet of paper. The air stabilization system, which is preferably mounted on the lower head, clamps the moving paper to cause it to exhibit an essentially flat sheet profile for measurement as the upper and lower heads travel back and forth in the cross direction over the width of the paper.

Figure 3:
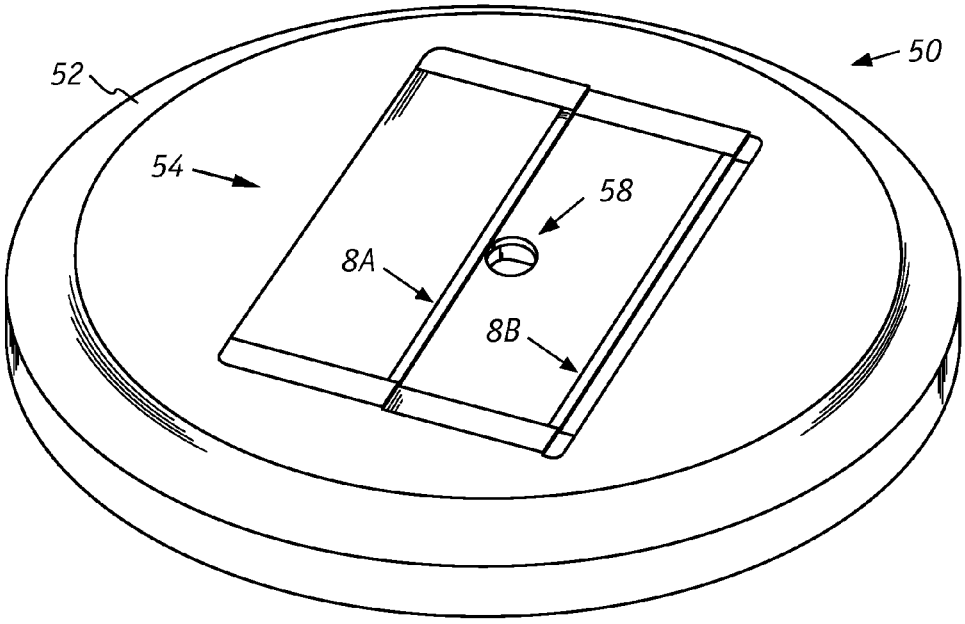
FIG. 3 shows the air stabilizer system as part of a sensor head.

FIG. 3 shows an air stabilization system that is incorporated into a recess compartment within substrate 52 that is part of lower head 50 of a scanning sensor. A measurement device is positioned in measurement orifice 58 between Coanda nozzles 8A and 8B. Substrate 52 is positioned so that a web product travels over the air stabilization system in machine direction 54 which is preferably transverse to the lengths of the elongated Coanda nozzles. In operation, substrate 52 scans back and forth along the cross direction to generate measurements of the paper along the cross direction. When employed for measuring the caliper of paper, in one embodiment, the distance between nozzles 8A and 8B is about 1.7 to 5 cm and preferably about 3.3 cm and the length of each nozzle along the cross direction is about 4 to 11 cm and preferably about 7.6 cm.

Non-contacting caliper sensors such as those disclosed in U.S. Pat. No. 6,281,679 to King et al., which is incorporated herein by reference, include upper and lower heads equipped with laser triangulation devices. The caliper of a moving sheet that travels between the two heads is determined by identifying the positions of the upper and lower surfaces of the sheet with the laser triangulation devices and subtracting the results from a measure of the separation between the upper and lower heads.

Figure 4:
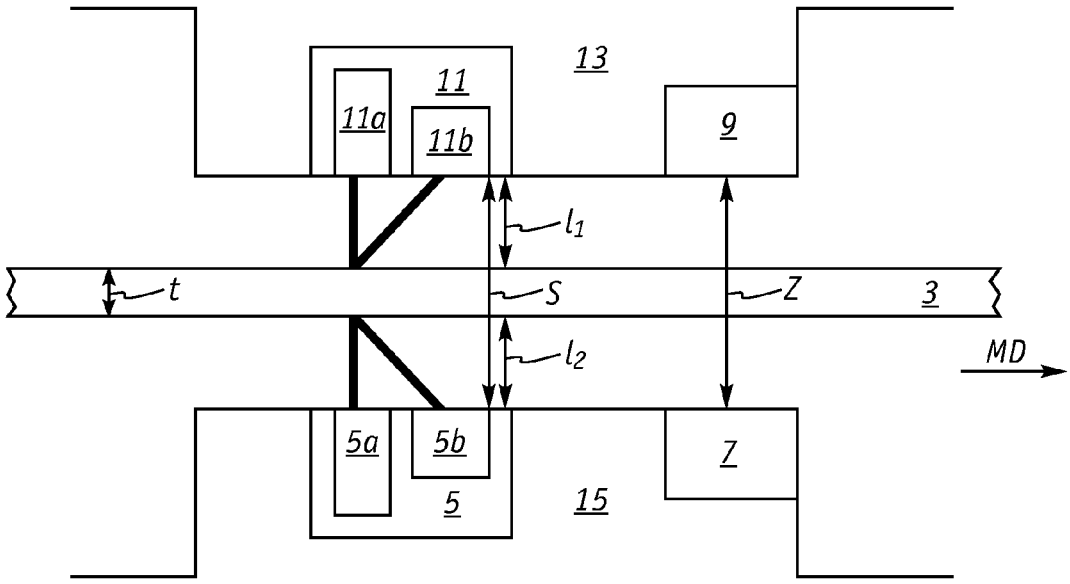
FIG. 4 is a cross sectional schematic view of a caliper measurement device.

FIG. 4 illustrates a representative non-contacting caliper sensor system that includes first and second scanner heads 13 and 15 respectively, which contain various sensor devices for measuring qualities, characteristics, or features of a moving web of material 3. Heads 13 and 15 lie on opposite sides of web or sheet 3, and, if the measurement is to be performed in a scanning manner across the web in the cross direction, the heads are aligned to travel directly across from each other as they traverse the moving web which is moving in the machine direction. A first source/detector 11 is located in first head 13. A second source/detector 5 is located in second head 15. Source/detectors 11 and 5 comprise closely-spaced first and second sources 11*a* and 5*a*, respectively, and first and second detectors 11*b* and 5*b*, respectively, arranged so that measurement energy from first source 11*a* and interacting with a first surface of web 3 will return, at least in part to first detector 11*b*, and measurement energy from second source 5*a* and interacting with the opposite, or second surface, of web 3 will return, at least in part to second detector 5*b*.

The source and detector preferably comprise a laser triangulation source and detector, collectively being referred to as an interrogation laser. The source/detector arrangement is referred to generally as a distance determining means. From the measured path length from the source to the detector, values for the distance between each distance determining means and a measurement or interrogation spot on one of the web surfaces may be determined. The heads 13 and 15 are typically fixed in the position so that the interrogations spots do not move in the machine direction even as the heads are scanned in the cross direction.

For first distance determining means 11, the detected distance value between the distance determining means and a first measurement spot on the web surface (referred to as $l_1$) and for second distance determining means 5, the detected distance value between the distance determining means and a second measurement spot on the opposite web surface (referred to as $l_2$). For accurate thickness determinations, the first and second measurement spots (or interrogation spots) are preferably at the same point in the x-y plane, but on opposite sides of the web, i.e. the measurement spots will be separated by the web thickness. In an ideal static situation, the separation, s, between first and second distance determining means 11 and 5 would be fixed, resulting in a calculated value for web thickness, t, of: $t=s-(l_1+l_2)$. In practice, separation s can vary. To correct for this inconstancy in the separation s, a dynamic measurement of the spacing between the scanning heads is provided by a z-sensor means, which measures a distance z, between a z-sensor source/detector 9, located in the first head 13, and a z-sensor reference 7, located in the second head 15.

Because the scanner heads do not retain perfect mutual alignment as a sheet scans between them, the air stabilization system of the present invention is employed to keep the sheet flat so that small head misalignments do not translate into erroneous caliper readings, i.e., caliper error due to head misalignment and sheet angle.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. An air stabilization system for non-contact support of a flexible continuous web that is moving in a downstream machine direction (MD) that comprises:

(a) a body having an operative surface facing the web wherein the operative surface has a web entry end and a web exit end that is downstream from the web entry end;

(b) a first nozzle, positioned at the web entry end, that defines a first slot that extends across the surface of the operative surface along a first direction that is substantially transverse to the MD and wherein a first elongated jet of pressurized gas is exhausted through the first slot in the downstream MD to impart a first controlled force on the web wherein the first nozzle comprises a slot in the body that is in fluid communication with a first source of gas and has a first elongated opening at a first surface of the body wherein the first slot has a first curved convex surface at the first elongated opening on its downstream side, wherein first elongated opening is disposed on a first segment of the operative surface which has a first upper portion and a first lower portion that is downstream from the first upper portion, wherein the first upper portion is vertically spaced from the first lower portion, and wherein the first upper portion and the first lower portion are substantially parallel to each other and the surface connecting the first upper portion to the first lower portion defines a first plane that is substantially perpendicular to the first upper portion and the first lower portion; and (c) a second nozzle, positioned at the web exit end, that defines a second slot that extends across the surface of the operative surface along a second direction that is substantially transverse to the MD wherein the second nozzle comprises a slot in the body that is in fluid communication with a second source of gas and has a second elongated opening at a second surface of the body wherein the second slot has a second curved convex surface at the second elongated opening on its downstream side, wherein the second elongated opening is disposed on a second segment of the operative surface which has a first upper portion and a first lower portion that is downstream from the first upper portion, wherein the second upper portion is vertically spaced from the second lower portion, and wherein the second upper portion and the second lower portion are substantially parallel to each other and the surface connecting the second upper portion to the second lower portion defines a second plane that is substantially perpendicular to the second upper portion and the second lower portion, wherein a second elongated jet of pressurized gas is simultaneously exhausted through the second slot in the downstream MD to impart a second controlled force on the web and whereby the first force and the second force maintain at least a portion of the moving web, that is located between the web entry end and the web exit end, at a substantially fixed distance to the operative surface, wherein the operative surface defines a continuous planar surface between the first slot and the second slot.

2. The system of claim 1 wherein the vertical distance between the first upper portion and the first lower portion is about 2 to 7 mm and the vertical distance between the second upper portion and the second lower portion is about 2 to 7 mm.

3. The system of claim 1 wherein the distance between the first elongated opening to the second elongated opening ranges from 1.7 to 5 cm.

4. The system of claim 1 comprising means for controlling the pressure of the first elongated jet and the pressure of the second elongated jet.

5. The system of claim 4 wherein the flow rate of the first elongated jet as it is exhausted from the first slot ranges from 2.5 to 7.0 cubic meters per hour and the flow rate of the second elongated jet as it is exhausted from the second slot ranges from 2.5 to 7.0 cubic meters per hour.

6. The system of claim 1 wherein the first slot has a length as measured along a cross direction that is transverse to MD that ranges from 4 to 11 cm and the second slot has a length as measured along a cross direction that is transverse to MD that ranges from 4 to 11 cm.

7. The system of claim 1 wherein the first nozzle and second nozzle are positioned in tandem such that the continuous moving web moving in the downstream machine direction is initially stabilized by forces generated by the first nozzle as the web approaches the first nozzle and subsequently the web is stabilized by forces generated by the second nozzle as the web approaches the second nozzle.

8. The system of claim 1 consisting of dual first and second nozzles, wherein the first nozzle is positioned along a first perimeter of the operative surface and the second nozzle is positioned along a second perimeter of the operative surface.

9. The system of claim 1 characterized in that for all of the nozzles each nozzle comprises a slot that extends along a direction that is substantially transverse to the MD and wherein an elongated jet of pressurized gas is exhausted through the slot in a downstream MD.

10. A system for monitoring a continuous web that is moving in a downstream machine direction (MD) that comprises:

(a) an air stabilization system for non-contact support of the flexible continuous web, which has a first surface and a second surface, that comprises:

(i) a body having an operative surface facing the web wherein the operative surface has a web entry end and a web exit end that is downstream from the web entry end;

(ii) a first nozzle, positioned on the operative face at the web entry end, that defines a first slot that extends across the surface of the operative surface along a first direction that is substantially transverse to the MD and wherein a first elongated jet of pressurized gas is exhausted through the first slot in the downstream MD to impart a first controlled force on the web wherein the first nozzle comprises a slot in the body that is in fluid communication with a first source of gas and has a first elongated opening at a first surface of the body wherein the first slot has a first curved convex surface at the first elongated opening on its downstream side, wherein first elongated opening is disposed on a first segment of the operative surface which has a first upper portion and a first lower portion that is downstream from the first upper portion, wherein the first upper portion is vertically spaced from the first lower portion, and wherein the first upper portion and the first lower portion are substantially parallel to each other and the surface connecting the first upper portion to the first lower portion defines a first plane that is substantially perpendicular to the first upper portion and the first lower portion; and (iii) a second nozzle, positioned on the operative face at the web exit end, that defines a second slot that extends across the surface of the operative surface along a second direction that is substantially transverse to the MD wherein the second nozzle comprises a slot in the body that is in fluid communication with a second source of gas and has a second elongated opening at a second surface of the body wherein the second slot has a second curved convex surface at the second elongated opening on its downstream side, wherein the second elongated opening is disposed on a second segment of the operative surface which has a first upper portion and a first lower portion that is downstream from the first upper portion, wherein the second upper portion is vertically spaced from the second lower portion, and wherein the second upper portion and the second lower portion are substantially parallel to each other and the surface connecting the second upper portion to the second lower portion defines a second plane that is substantially perpendicular to the second upper portion and the second lower portion, wherein a second elongated jet of pressurized gas is simultaneously exhausted through the second slot in the downstream machine direction to impart a second controlled force on the web and whereby the first force and the second force maintain at least a portion of the moving web, that is located between the web entry end and the web exit end, at a substantially fixed distance to the operative surface, wherein the operative surface defines a continuous planar surface between the first nozzle and the second nozzle;

(b) a first sensor head that is disposed adjacent the first surface of the web; and (c) means for regulating the flow rate of the first jet of gas and the flow rate of the second jet of gas to control the web's profile along the process path over the operative surface.

11. The system of claim 10 wherein the first sensor head is disposed within the body such that an active surface of the first sensor head is flushed with the operative surface and the system further comprising (d) a second sensor head that is disposed adjacent the second surface of the web.

12. The system of claim 11 wherein the first sensor includes means for measuring the distance between the first sensor and the first surface and the second sensor includes means for measuring the distance between .the second sensor and the second surface and wherein the system further includes means for measuring the distance between the first sensor and the second sensor.

13. The system of claim 10 wherein the vertical distance between the first upper portion and the first lower portion is about 2 to 7 mm and the vertical distance between the second upper portion and the second lower portion is about 2 to 7 mm, wherein the distance between the first elongated opening to the second elongated opening ranges from 1.7 to 5 cm, and wherein the flow rate of the first elongated jet as it is exhausted from the first slot ranges from 2.5 to 7.0 cubic meters per hour and the flow rate of the second elongated jet as it is exhausted from the second slot ranges from 2.5 to 7.0 cubic meters per hour.

14. The system of claim 10 wherein the first nozzle and second nozzle are positioned in tandem such that the continuous moving web moving in the downstream machine direction is initially stabilized by forces generated by the first nozzle as the web approaches the first nozzle and subsequently the web is stabilized by forces generated by the second nozzle as the web approaches the second nozzle.

15. The system of claim 10 consisting of dual first and second nozzles, wherein the first nozzle is positioned along a first perimeter of the operative surface and the second nozzle is positioned along a second perimeter of the operative surface.

16. The system of claim 10 characterized in that for all of the nozzles each nozzle comprises a slot that extends along a direction that is substantially transverse to the MD and wherein an elongated jet of pressurized gas is exhausted through the slot in a downstream MD.

* * * * *